US005168648A

United States Patent [19]

Brandl et al.

[11] Patent Number: 5,168,648

[45] Date of Patent: Dec. 8, 1992

[54] MAGAZINE FOR A FIREARM

[75] Inventors: Rudolf Brandl, Dornhan-Weiden; Helmut Danner, Sulz-Sigmarswangen, both of Fed. Rep. of Germany

[73] Assignee: Heckler & Koch GmbH, Fed. Rep. of Germany

[21] Appl. No.: 671,724

[22] PCT Filed: Aug. 23, 1989

[86] PCT No.: PCT/EP89/00991

§ 371 Date: Mar. 28, 1991

§ 102(e) Date: Mar. 28, 1991

[87] PCT Pub. No.: WO90/03546

PCT Pub. Date: Apr. 5, 1990

[30] Foreign Application Priority Data

Sep. 30, 1988 [DE] Fed. Rep. of Germany ..... 3833229

[51] Int. Cl.[5] ..... F41A 9/65

[52] U.S. Cl. ..... 42/50

[58] Field of Search ..... 42/50, 7, 18, 22

[56] References Cited

U.S. PATENT DOCUMENTS

| | | | |
|---|---|---|---|
| 3,383,790 | 5/1968 | Into | 42/50 |
| 3,516,189 | 6/1970 | Lewis et al. | 42/50 |
| 3,732,643 | 5/1973 | Wells | 42/50 |
| 4,127,954 | 12/1978 | Hausmann | 42/50 |
| 4,888,900 | 12/1989 | Howard | 42/50 |

FOREIGN PATENT DOCUMENTS

| | | |
|---|---|---|
| 3535014 | 4/1986 | Fed. Rep. of Germany . |
| 1564367 | 4/1969 | France . |
| 8200878 | 3/1982 | PCT Int'l Appl. . |

*Primary Examiner*—Charles T. Jordan

*Attorney, Agent, or Firm*—Walter A. Hackler

[57] ABSTRACT

A magazine for a firearm includes a plastic housing for receiving cartridges that can be loaded in a direction toward a discharge opening of the magazine by a device producing a constraining force. In addition, at least one magazine lip is provided for supporting a cartridge in an area of the discharge opening. A part of the magazine lip forming a support and/or a guiding element for the cartridge while the cartridge is pushed out of the magazine is reinforced by an insert. The insert consists of a sectional bar such as a round bar.

10 Claims, 3 Drawing Sheets

MAGAZINE FOR A FIREARM

BACKGROUND OF THE INVENTION

The present invention relates to a magazine for a firearm comprising a housing made substantially of a plastic material for receiving cartridges that can be loaded in a direction toward a discharge opening of the magazine by a device producing a constraining force, and comprising further at least one magazine lip supporting the cartridge in the area of the discharge opening, a part of the magazine lip forming a support and/or a guiding element for the cartridge while the latter is pushed out of the magazine being reinforced by an insert.

A magazine of this type is generally known from DE-OS 35 35 014 which does not, however, provide more information regarding the insert. The insert is said to serve the purpose to protect the magazine, and in particular the magazine lips, from premature wear which in the absence of the insert would be caused by the leading sleeve edge scraping along those parts of the magazine which support the cartridge during the feeding motion of the cartridge, i.e. as the cartridge is pushed out of the magazine. In practice, all inserts of this type provided heretofore were always in the form of punched parts which means that their production is expensive. In the case of one magazine known from U.S. Pat. No. 4,127,954, the delivery end of the magazine is altogether made from metal.

SUMMARY OF THE INVENTION

Now, it is the object of the present invention to provide a magazine of the before-mentioned type which can be produced at lower production cost. The invention achieves this object by the fact that the insert consists of a bent sectional bar, for example a round bar.

One advantage of the invention is seen in the fact that the insert can be produced from a sectional bar of a suitable material with the aid of simple devices, by a simple cutting and bending operation. The mold used for producing the plastic housing of the magazine then has to be changed a little, as compared to the form used heretofore, in order to enable the insert to be fixed in place, in particular to be fixed in a detachable manner, as envisaged by one embodiment of the invention. The sectional bar may, advantageously, consist of a round metal bar, i.e. a wire of a suitable material, preferably steel.

According to one embodiment of the invention, the insert comprises two sections extending substantially parallel one to the other, and a yoke extending substantially transversely thereto. It is an advantage of this arrangement that the insert is particularly easy to produce. The yoke, that may be slightly curved, may serve in this case as the actual guide for the cartridge when the latter is being pushed out, and/or as cartridge support.

According to one embodiment of the invention, the yoke is located at least in part outside a plane extending through the two sections. The advantage of this arrangement is seen in the fact that this insert is particularly well suited for being mounted in the housing in a detachable or undetachable way.

According to one embodiment of the invention, the insert comprises a first section which extends substantially in parallel to the shell of a cartridge stored in the magazine, and in the area of the shell, and which supports the shell against the action of the constraining force, and further a second section arranged in the area of the projectile and extending at an angle relative to the first section. With this arrangement it is possible to support the cartridge completely and to have the leading and the trailing ends of the cartridge supported by the insert as the cartridge is being pushed out.

According to one embodiment of the invention, the second section is spaced a greater distance from the upper end of the magazine than the first section. In the case of this arrangement, the first section provides mainly a supporting action for the constraining force, in particular the force of a follower spring, while the second section serves mainly for changing the direction of the cartridge as the latter is pushed out of the magazine.

According to one embodiment of the invention, an end portion of the insert, being in alignment with a section of the insert forming a guide, is fitted in a bore of the magazine for fixing the insert in position. This arrangement permits easy mounting of the insert.

According to one embodiment of the invention, where the insert is fastened on the housing in a detachable way, the insert is made from an elastically deformable material and clicked into place behind a part of the housing. This enables the insert to be removed from the housing and replaced by a new insert easily, if this should become necessary. According to another embodiment of the invention, the insert may also be fixed undetachably in the housing, for example by applying an adhesive before the insert is mounted. The clicking operation then merely provides additional safety against the insert getting lost.

According to one embodiment of the magazine, where the latter has a double-row design and guiding surfaces which when a cartridge is being pushed out deflect the latter in a direction toward the longitudinal center plane of the magazine which extends in parallel to the longitudinal direction of the cartridge and to the longitudinal direction of the two cartridge columns that can be stored in the magazine, it is provided that the guiding surfaces are reinforced by an insert. It may be necessary in this connection to provide first inserts for supporting the cartridges against the before-mentioned constraining force that may be produced by a follower under the action of a follower spring, and additional inserts arranged in the before-mentioned guiding surfaces for deflecting the cartridges towards the center plane of the magazine as the cartridges are being pushed out in order to enable the cartridges to be introduced into the firearm correctly. The first and the second inserts may be formed jointly as a single part.

BRIEF DESCRIPTION OF THE DRAWINGS

Other features and advantages of the invention will be apparent from the following description of certain embodiments of the invention, in conjunction with the drawing that shows details which are essential for the invention, and the claims. It should be noted that the different features may be implemented in any embodiment of the invention either individually or in any combination. In the drawing.

Figure 1:
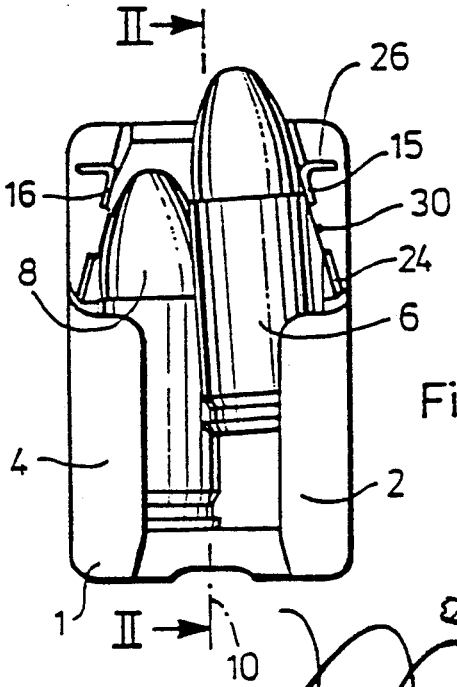
FIG. 1 shows a top view of the discharge opening of a first example of a double-row magazine, where the uppermost cartridge projects already a little from the magazine.
Figure 2:
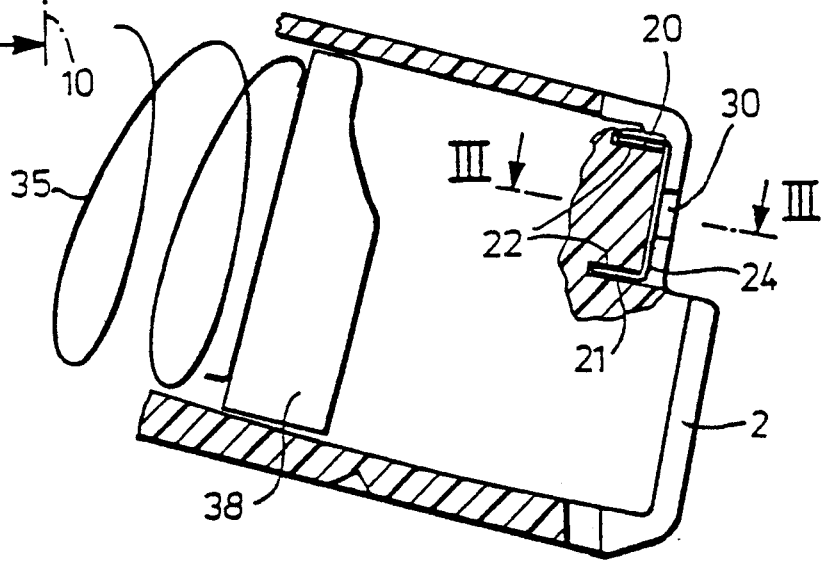
FIG. 2 shows a section along the longitudinal center plane of the magazine, according to line II—II in FIG.
Figure 3:
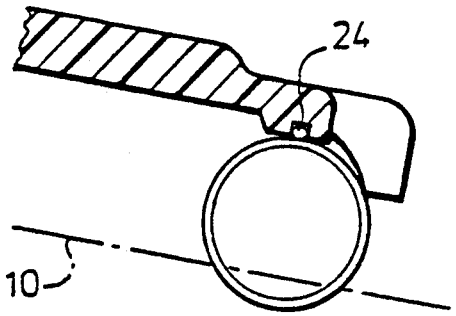
Figure 4:
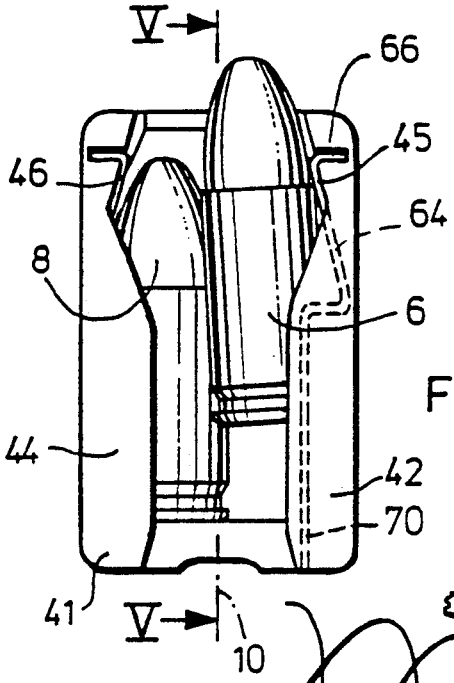
Figure 5:
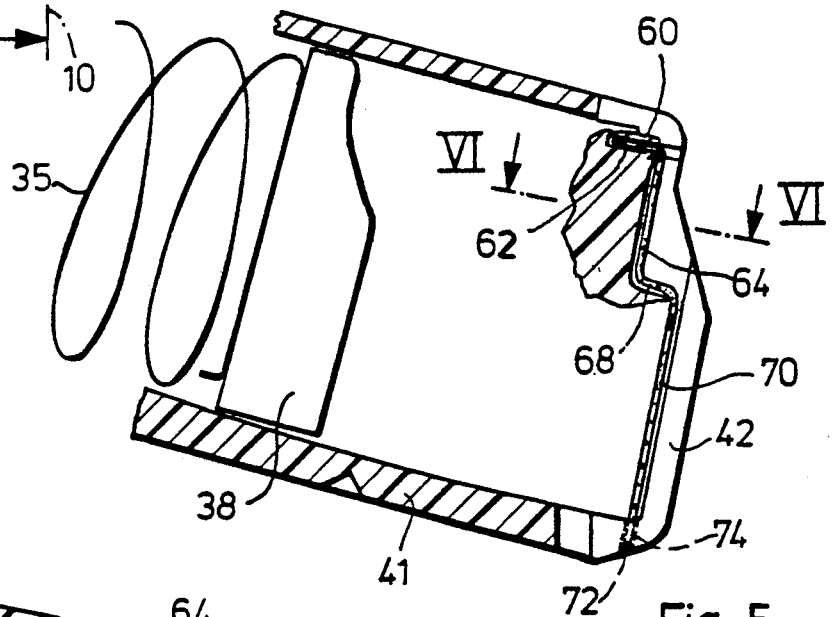
Figure 6:
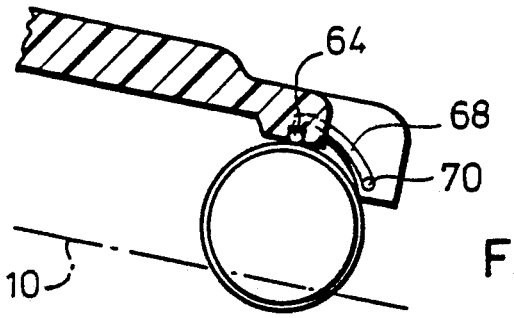
Figure 7:
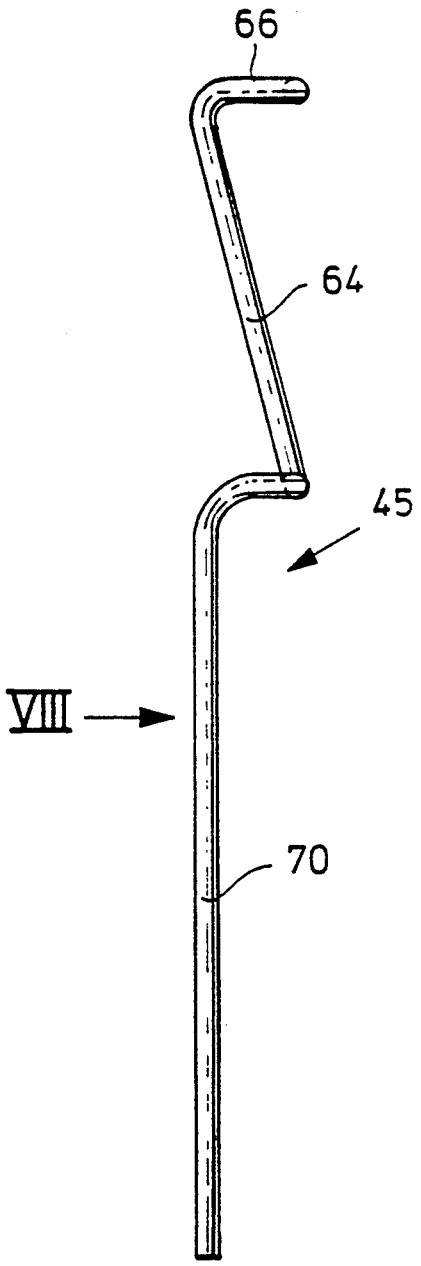
Figure 8:
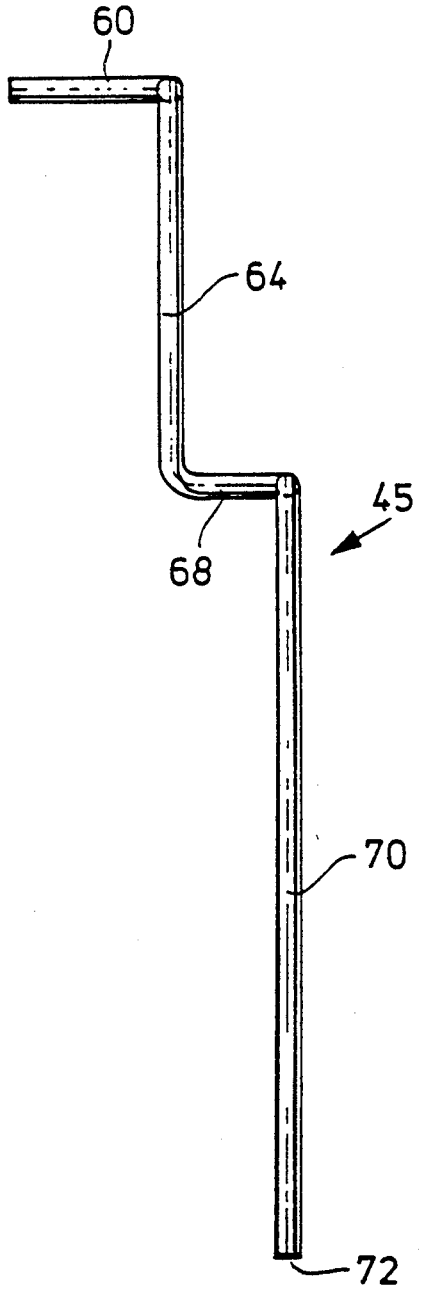

1, with the wall of the magazine partly broken away, without cartridges, but with the follower;

FIG. 3 shows a section along line III—III in FIG. 2 in enlarged scale, illustrating diagrammatically the contact between a cartridge and the insert;

FIG. 4 shows a top view similar to that of FIG. 1, but of a second embodiment of a magazine;

FIG. 5 shows a section along the longitudinal center plane of the magazine, according to line V—V in FIG. 4, similar to the representation of FIG. 2;

FIG. 6 shows a section along line VI—VI in FIG. 5, in enlarged scale, similar to the representation of FIG. 3;

FIG. 7 shows a top view of one of the inserts of the second embodiment, viewed in the direction of FIG. 4; and FIG. 8 shows a side view in the direction of arrow VIII in FIG. 7.

DETAILED DESCRIPTION

Regarding now FIGS. 1 to 3, a double-row magazine comprises a magazine housing 1 consisting of a plastic material, the housing being provided on its discharge end with two magazine lips 2 and 4 intended for supporting alternately, in the conventional manner, the uppermost cartridge in the magazine. In the illustrated example, the uppermost cartridge is the one (6) illustrated at the right in FIG. 1, which has its rear end still supported by the lip 2. The next following cartridge 8 is not yet in contact with the lip 4, because the individual cartridges project a little beyond the longitudinal center plane 10 of the housing 1 so that the cartridge 8 is supported by the cartridge 6 in upward direction, i.e. in the direction perpendicular to the drawing plane of FIG. 1.

The magazine lips 2 and 4 may, in certain embodiments of the invention, include inserts not shown in the drawing. The figures only show those inserts which deflect the cartridges toward the center plane 10 of the magazine when the cartridges are pushed out of the magazine. The inserts 15 and 16 are of mirror-symmetrical design relative to the longitudinal center plane 10. Consequently, the following description will concentrate only on the insert 15, there being no need to describe the other insert as well. The insert 15 comprises two legs 20 and 21 of equal length which are provided in parallel, spaced arrangement and fitted in bores 22 of the housing 1. The bores 22 may be formed integrally with the housing 1 and by the same operation by which the latter is injection-molded from a plastic material. The leg 21 is followed by a yoke 24 extending at an angle of 90° relative to the leg 21. The end of the yoke opposite the leg 21 terminates in a short section 26, the short section 26 and the yoke 24 enclosing between them an acute angle of approx. 80°, in the present example, as can be seen best in FIG. 1. The short section 26 and the yoke 24 extend parallel to the drawing plane of FIG. 1, and the legs 20 and 21 extend at a right angle to the drawing plane of FIG. 1. The end of the short section 26 opposite the yoke 24 is followed by the leg 20 which extends at a right angle to the short section 26. Consequently, the yoke 24 extends, over the greatest part of its length, outside of a plane extending through the legs 20 and 21 and at a small angle relative to the longitudinal center plane 10 in a manner such that when the cartridge is being pushed out (upwardly in FIG. 1) it is deflected toward the longitudinal center plane 10 as it slides along the yoke 24.

The inserts 15 and 16 are fixed on the housing 1, after production of the latter, by inserting the legs 20 and 21 into the bores 22. During this operation, the yoke 24 is deformed elastically in the direction toward the longitudinal center plane 10 in order to enable it to move past a detent 30 and to be clicked in place below the latter. In the fully assembled condition, the yoke 24 is engaged by the detent so that the insert element 15 is prevented from slipping off the bores 22. The detent 30 engages the yoke 24 only over a length substantially equal to the thickness of the yoke 24. During the outward movement of the cartridge no part of the cartridge gets into contact with the detent. FIG. 2 shows additionally, in a simplified manner, the follower 38 under the action of the follower spring 35.

The magazine illustrated in FIGS. 4 to 6 differs from that illustrated in FIGS. 1 to 3 only in the area of the discharge opening of the magazine, the difference consisting mainly in the use of an insert of different design. Hereafter, only these differences will be discussed.

The magazine housing 41 comprises lips 42 and 44. In the area of these lips, there are provided metal inserts 45 and 46, respectively, of mirror-symmetrical design, one relative to the other. Hereafter, only the insert 45 will be described, which is in addition shown in enlarged scale in FIGS. 7 and 8. The insert 45 comprises a section 60, comparable to the section 20 of FIG. 2, which is fitted in a bore 62 extending in the longitudinal direction of the magazine housing 41. The section 60 is followed by a section 66, comparable to the section 26, and the section 66 in its turn terminates by a section 64, comparable to the section 24, which again extends at a certain angle relative to the longitudinal center plane of the magazine housing so as to deflect the cartridge, as the latter is being pushed out, in a direction toward the longitudinal center plane. At the end of the section 64 opposite the section 66, the steel wire forming the insert 45 is bent off in a direction substantially opposite to that of section 60, thus forming a section 68 whose end is again bent off substantially at a right angle, forming thereafter a straight section 70, extending in parallel to the section 64, right to the end 72 which is fitted in a bore 74 of the housing 41. The section 68 interconnecting the section 70 and the section 64 is curved in a manner matching the cylindrical shape of the cartridge shell so as to ensure that the contact between the cartridge and the section 70 will not be disturbed by this section 68. As long as the cartridge has not been pushed out fully from the magazine, the section 70 extends substantially in the area of the shell of the cartridge, over the whole length of the cartridge, thus providing an effective support for the rear end of the shell, in particular during deflection of the cartridge in the direction of the longitudinal center plane, whereby that edge is prevented from wearing the magazine, scraping along the plastic parts by the cartridge.

The function of the section 64 corresponds to that of section 24, as described in connection with the first example. If one regards the cartridge being just delivered as the uppermost cartridge in the magazine, then the section 64 is in contact with the projectile of the cartridge at approximately half the height of the cartridge and, thus, substantially laterally. In contrast, in the case of the uppermost cartridge that has not yet been pushed out a certain length from the magazine, the section 70 is in contact with the shell at a point set off in outward direction by approximately 4 mm relative to the upper surface line of the shell.

The section 60 prevents the insert 45 from getting displaced in the longitudinal direction of the section 70. In addition, the insert 45 is prevented from slipping off the magazine in the longitudinal direction of the section 60, on the one hand by the engagement of the end 72 in the bore 74 and on the other hand by a groove in the magazine housing which is engaged by the section 64 and the section 70. The groove enables the insert 45 to be fixed in the magazine, after the latter has been produced as a single piece by an injection molding process, by inserting the insert 45 initially into the bore 74 and deforming it thereafter elastically a small amount so that the section 60 can be introduced into its matching bore 62 and can click into place in the groove the latter having a depth smaller than the wire thickness.

The magazines of the described examples are designed to take 30 rounds of 9 mm Parabellum ammunition. The insert elements or inserts 15, 16, 45, 46 are produced by bending from steel wire of circular cross section and a thickness of approximately 0.6 mm. For the part 15, the yoke 24 has a length of approximately 11 mm, the legs 20 and 21 have a length of approximately 5 mm. The length of the part 45 visible in FIGS. 7 and 8 is equal to approximately 31 mm.

What is claimed is:

1. Magazine for a firearm comprising a housing made substantially of a plastic material for receiving cartridges that can be loaded in a direction toward a discharge opening of the magazine by a device producing a constraining force, and comprising further at least one magazine lip supporting the cartridge in the area of the discharge opening, a part of the magazine lip forming a support and/or a guiding element for the cartridge while the cartridge is pushed out of the magazine, said part of the magazine lip being reinforced by an insert, said insert comprising a sectional bar.

2. Magazine according to claim 1, wherein the said insert is mounted detachably in the housing.

3. Magazine according to claim 1 wherein the insert comprises two sections extending substantially parallel one to the other, and a yoke extending substantially transversely thereto.

4. Magazine according to claim 3, wherein the yoke is located at least in part outside a plane extending through the two sections.

5. Magazine according to claim 1 wherein the insert comprises a first section which extends in the area of a shell of a cartridge stored in the magazine and substantially in parallel to the shell, said first section supporting the shell against the action of the constraining force, and a second section arranged in the area of a projectile of the cartridge and extending at an angle relative to the first section.

6. Magazine according to claim 5, wherein the second section is spaced a greater distance from an upper end of the magazine than the first section.

7. Magazine according to claim 1 wherein an end portion of the insert is in alignment with a section of the insert forming a guide and is fitted in a bore in said magazine for fixing the insert in position.

8. Magazine according to claim 1 wherein the insert is fastened on the housing in a detachable way, and wherein the insert is made from an elastically deformable material and clicked into place behind a projection of the housing.

9. Magazine according to claim 1 wherein the magazine is sized to support double-row columns of cartridges and includes guiding surfaces which, when a cartridge is being pushed out of the magazine deflect the cartridge in a direction toward a longitudinal center plane of the magazine, said longitudinal center plane extending parallel to a longitudinal direction of the cartridge and to a longitudinal direction of the two cartridge columns that can be stored in the magazine, said guiding surfaces being reinforced by an insert.

10. Magazine according to claim 1 wherein said sectional bar comprises a round bar.

* * * * *